US006007329A

United States Patent [19]

Meyer

[11] Patent Number: 6,007,329

[45] Date of Patent: Dec. 28, 1999

[54] EMITTER APPARATUS

[75] Inventor: Jens-Uwe Meyer, Suffield, Conn.

[73] Assignee: Infratech, L.L.C., Atlanta, Ga.

[21] Appl. No.: 09/193,183

[22] Filed: Nov. 16, 1998

[51] Int. Cl.[6] ..... F23D 14/14

[52] U.S. Cl. ..... 431/328; 431/326

[58] Field of Search ..... 431/326, 328, 431/329; 126/92 AC

[56] References Cited

U.S. PATENT DOCUMENTS

| | | | |
|---|---|---|---|
| 3,407,025 | 10/1968 | Hardison | 431/329 |
| 4,272,237 | 6/1981 | Smith | 431/328 |
| 4,492,564 | 1/1985 | Wolf | 431/328 |
| 5,360,490 | 11/1994 | Nelson | 431/328 |
| 5,820,361 | 10/1998 | Lavigne et al. | 431/329 |

*Primary Examiner*—Ira S. Lazarus
*Assistant Examiner*—Sara Clarke
*Attorney, Agent, or Firm*—Howard J. Greenwald

[57] ABSTRACT

A gas fired infrared radiation emitter which contains a back-body provided with a distributor, a primary radiator having a combustion surface, and frame which contains four receptacles, each of which is integrally connected to the frame. A screen is removably attached to the frame receptacles by means of two bars, each of which is disposed within the receptacles and is free to move within the receptacles in either direction for a distance of at least about 0.15 inches. Stop surfaces are provided, however, for limiting the amount of longitudinal movement of the bars within the receptacles. The bars each have a length which does not exceed the length of the frame; and they can readily be removed from the receptacles.

15 Claims, 3 Drawing Sheets

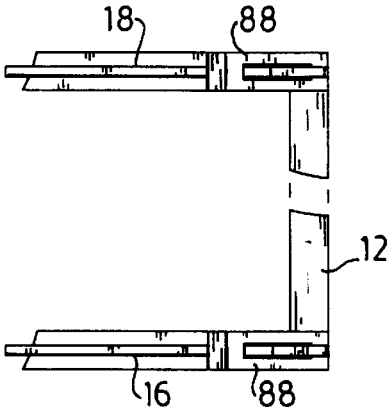
FIG. 8
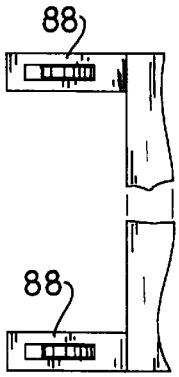
FIG. 9
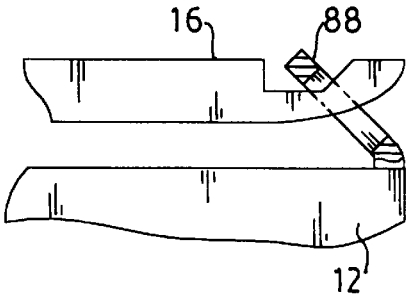
FIG. 10
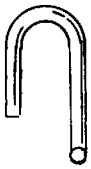
FIG. 11
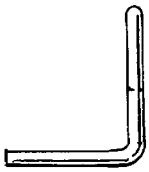
FIG. 12
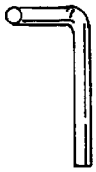
FIG. 13
FIG. 14
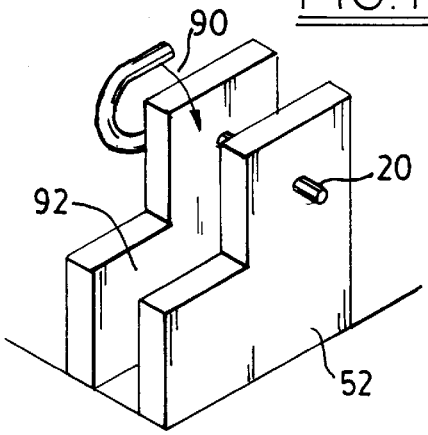
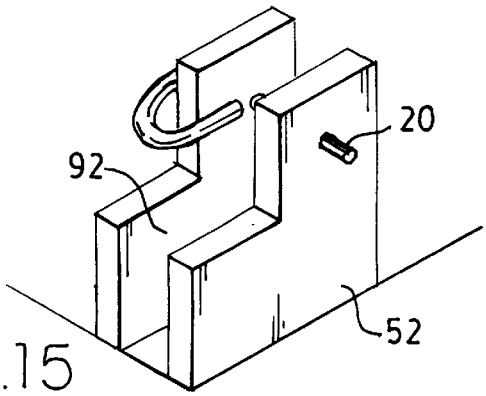
FIG. 15

EMITTER APPARATUS

FIELD OF THE INVENTION

A gas fired infrared radiation emitter with a removable reverberating screen which is substantially less likely during use to fall from the emitter.

BACKGROUND OF THE INVENTION

Gas fired infrared radiation emitters are widely used in the pulp and paper industry for the drying of coatings on moving cellulosic webs. These emitters are well known; thus, for example, one such emitter is described in U.S. Pat. No. 5,820,361 of Daniel M. Lavigne et al.

The prior art infrared radiation emitters often contain a reverberating screen (or "grating") which increases the radiant power output of the emitter while simultaneously protecting the primary radiating surface from contamination. In some of the prior art embodiments, the screen is integrally connected to the emitter; thus, in these embodiments, when the screen fails due to excessive temperature, contamination, and/or normal wear and tear, the entire emitter must be replaced. When this occurs, not only must one bear the expense of a brand new emitter, but one loses a substantial amount of production time while replacing the emitter.

In the device disclosed in Belgium patent 09501070, an emitter with a removable grating is disclosed (see, e.g., column 1 of U.S. Pat. No. 5,820,361). However, as the patentees of U.S. Pat. No. 5,820,361 disclosed, the device of such Belgium patent was essentially inoperable in that "During tests at high temperatures this radiant however exhibited a risk of the grating falling, such fall then necessitating stopping the drying installation " (see lines 29–31 of Column 1 of U.S. Pat. No. 5,820,361).

The expressed objective of U.S. Pat. No. 5,820,361 is to remedy the screen falling problem. Thus, at lines 10–40 of Column 7 of such patent, it is disclosed that "The heat emitter . . . represented in FIGS. 1 through 4 has numerous advantages . . . . These advantages are . . . . The risk of the screen or grating falling is almost nil."

However, despite this expressed objective, none of the embodiments depicted in this patent in fact contained a removable screen which did not fall during high temperature use. Heat emitters corresponding to the claimed embodiments in this patent were sold by IDS International, Inc. of Windsor Locks, Connecticut under the name of "OPTIRAY GAS EMITTER "; however, during high temperature use of these emitters (in excess of 2,000 degrees Fahrenheit), a substantial number of the removable screens on such emitters invariably fell off.

It is an object of this invention to provide a gas fired infrared emitter with a removable screen which does not fall off during high temperature use.

It is another object of this invention to provide a gas fired infrared emitter whose radiant output is substantially higher than prior art emitters.

SUMMARY OF THE INVENTION

In accordance with this invention, there is provided a gas fired infrared emitter which is comprised of a back body provided with a distributor for distributing a fuel-oxygen containing gas mixture, a primary radiating surface contiguous with said back body, a frame removably connected to said back body, a screen removably connected to such frame by means of connectors integrally formed with such frame.

BRIEF DESCRIPTION OF THE DRAWINGS

The invention will be described by reference to the specification and to the drawings, in which like numerals refer to like elements, and wherein:

FIG. 8 is partial top view of one end of the emitter of FIG. 1 illustrating another preferred means of securing the retaining bar, showing said rod disposed within a closed slot;

FIG. 9 is a partial top view of another end of the emitter of FIG. 8, with the rod omitted for the sake of simplicity of reprsenation;

FIG. 10 is a partial side view of the emitter locking structure of FIG. 8;

FIGS. 11, 12, 13 are top views of various connectors which may be used in the devices of this invention; and FIGS. 14 and 15 illustrate one preferred connection means.

DESCRIPTION OF THE PREFERRED EMBODIMENTS

Infrared emitters are well known to those skilled in the art and are described, e.g., in U.S. Pat. Nos. 5,520,536, 5,464,346, 5,306,140, 4,830,651, 4,722,681, 4,654,000, 4,604,054, 4,589,843, 4,500,283, 4,039,275, 3,852,025, and the like. The disclosure of each of these United States patents is hereby incorporated by reference into this specification.

By way of further illustration, U.S. Pat. No. 5,820,361 of Daniel M. Lavigne et al. discloses a heat emitter comprising: (a) a back-body provided with a distributor for distributing a fuel-oxygen containing gas mixture, (b) an organ having a combustion surface, (c) a frame receiving at least partly said organ and connecting said back-body with said organ, (d) a screen, (e) at least a pair of flanges facing each other attached to said back-body, each flange provided with a hole, the hole of a first flange of said pair being distant from the hole of the second flange of said pair, and (f) at lest one sliding bar extending longitudinally between a first end part and a second end part opposite to said first end part, said sliding bar having a length greater than the distance separating the hole of a first flange of said pair from the hole of the second flange of said pair, said first end part and said second end part having respectively a cross section, adapted for being engaged in the hole of said first flange, and a cross section adapted for being engaged in the hole of a second flange. The entire disclosure of this Lavigne et al. patent is hereby incorporated by reference into this specification.

The device of this patent application is a substantial improvement over the device described and claimed in the Lavigne et al. patent. One preferred embodiment thereof will be described by reference to the Figures.

Figure 1:
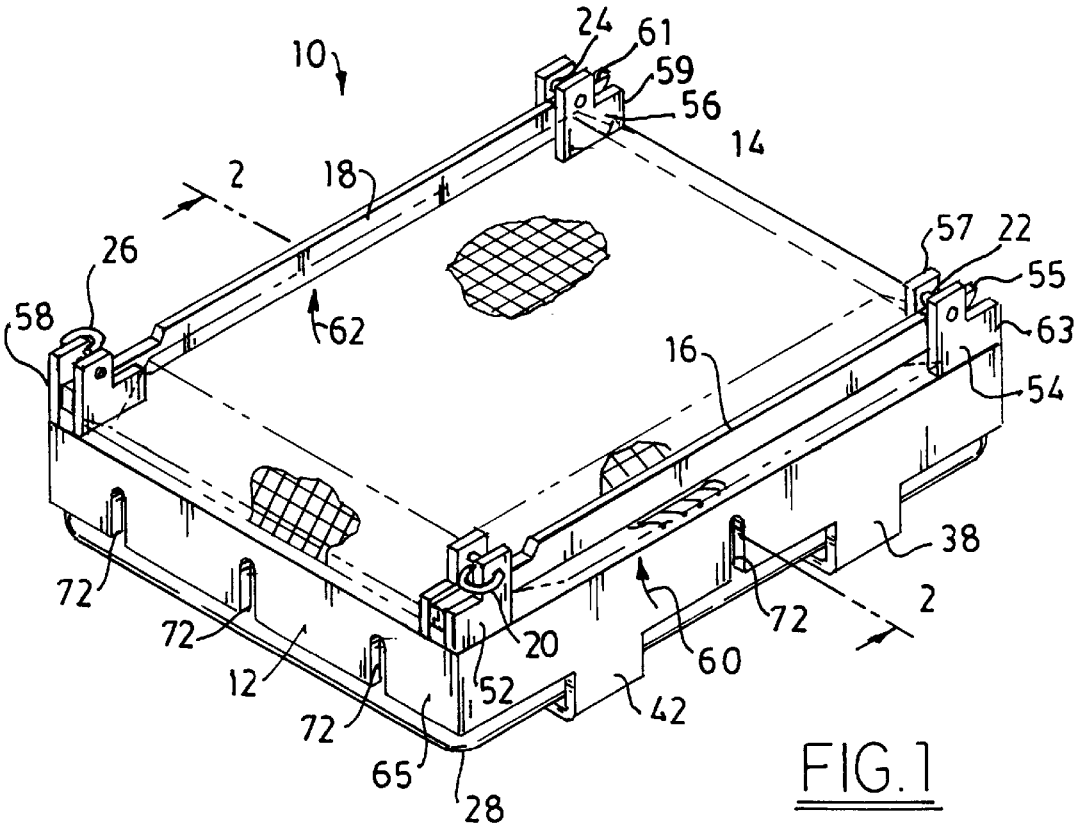
FIG. 1 is a perspective view of one preferred embodiment of the invention.

Referring to FIG. 1, it will be seen that emitter 10 is comprised of a frame 12, a screen 14 removably connected to the frame 12 by means of a first retaining bar 16 and a second retaining bar 18, each of which is removably connected to such frame 12 by means of connectors 20, 22 (retaining bar 16) and 24 and 26 (retaining bar 18). The frame 12 is integrally connected to back body 28.

Figure 2:
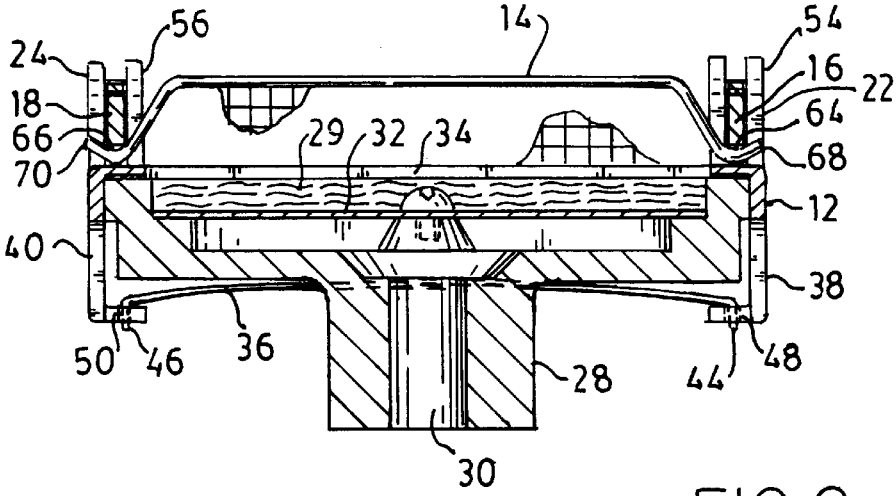
FIG. 2 is a sectional view of the embodiment of FIG. 1, taken along lines 2—2.
Figure 5:
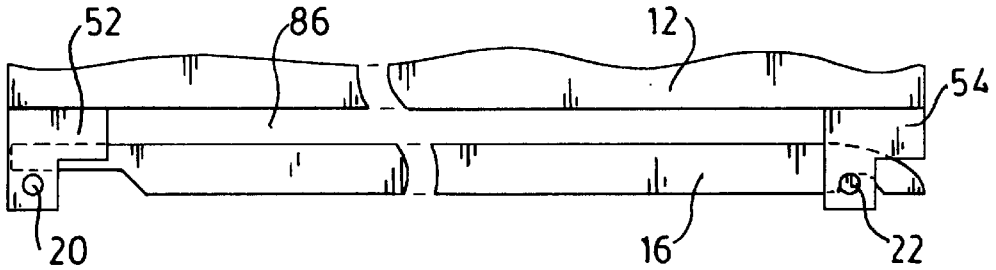
FIG. 5 is a second side view of the retaining bar/frame structure of FIG. 4 showing the emitter radiating downwardly.

FIG. 2 is a sectional view of the emitter 10 of FIG. 1, taken along lines 2—2. It will be seen that a fuel-oxygen gas mixture 29 may be flowed through orifice 30 and diffuser 32.

The function of diffuser 32 is to equalize the pressure behind primary radiator 34. Combustion preferably occurs within primary radiator 34, which can consist essentially of metallic fiber, ceramic fiber, perforated ceramic material, etc. In the preferred embodiment illustrated in FIG. 1, the primary radiator 34 is a mat of sintered metal fibers with a thickness of about 3.0 millimeters. In one embodiment, the primary radiator has a surface area of about 48 square inches.

Referring again to FIG. 2, the back body 28 is preferably removably connected to frame 12. In the preferred embodiment depicted, a spring 36 is connected between a flange 38 integrally formed with frame 12 (see FIG. 1, and also FIG. 2), and an opposing flange 40 integrally formed with frame 12 (not shown in FIG. 1, but see FIG. 2). It will be apparent that the emitter 10 also contains a flange 42 (see FIG. 1) and an opposing flange (not shown) also connected by a spring (not shown).

Referring again to FIG. 2, it will be seen that spring 36 is comprised of a nubs 44 and 46 adapted to be removably disposed within orifices 48 and 50 of flanges 38 and 40. By means of the pressure exerted by spring 36, and by the corresponding spring on the other side of the emitter 10, the back body 28 is fixed within frame 12, and the primary radiator 34 is maintained in spaced apart relationship with diffuser 32. A gas-tight seal is formed between the frame 12 and the back body 28.

In the device depicted in U.S. Pat. No. 5,820,361, the flanges are mounted on the back body by means of screws. By comparison, and referring to FIGS. 1 and 2, slotted receptacles 52, 54, 56, and 58 are integrally formed with frame 12. This integral connection may be formed by conventional means such as, e.g. casting, welding, etc. Disposed within slotted receptacles 52 and 54 is bar 16. Disposed within slotted receptacles 56 and 58 is bar 18.

It is noteworthy that U.S. Pat. No. 5,820,361 explicitly teaches that the structure used in applicant's device should not work. Thus, at lines 35 to 44 of Column 3 of this patent, it is disclosed that "In the heat emitter of the invention, the body bears the flanges or lugs. Indeed, the frame is subjected to very high temperature and almost cannot be cooled, so that the expansion of the frame is liable to be significant. Thus, were the lugs mounted directly onto the frame, these lugs would undergo real movements or expansion, but equally movements due to the expansion of the frame. Too significant movements of expansion can be the cause of the disengagement of an extremity of a small bar out of the lug hole, and consequently the cause of a fall of the grating."

In applicant's claimed device, by comparison, and referring again to FIGS. 1 and 2, the back walls 55, 57, 59, and 61 of receptacles 54 (walls 55 and 57) and 56 (walls 59, and 61) are recessed from the end wall of frame 63 by a distance of preferably at least about 0.2 inches. The lengths of rods 16 and 18 are such that they extend at least from frame end 63 to frame end 65. Thus, even if the distance between receptacles 52 and 54, or between receptacles 56 and 58, were increased due to heat expansion of the frame 12, the bars 16 and 18 are sufficiently long that they will continue to be disposed within their respective slotted receptacles.

In one preferred embodiment, not specifically shown in FIGS. 1 and 2, bars 16 and 18 are so configured that there is some "play " between them and the connectors on each end of the frame 12. Thus, even if such bars do expand, they will remain disposed within their respective slotted receptacles and will still remain connected to their respective connectors. It is thus preferred that, in one embodiment, each of bars 16 and 18 can move in either direction at least about 0.15 inches, but preferably less than about 0.5 inches. In general, it is preferred that each of bars 16 and 18 be free to move in either direction for a distance which is at least about 1.5 percent of the total length of the bar 16, or the bar 18.

In the preferred embodiment depicted in FIGS. 1 and 2, it will be seen that frame 12 is comprised of a multiplicity of expansion slots 72. It will also be seen, by reference to the embodiment of FIG. 1, that the receptacles 52 and 58 are substantial mirror images of each other. As will be apparent to those skilled in the art, when a multiplicity of emitters 10 are placed side by side in rows, this mirror image arrangement allows one unimpeded access to fasteners 20 and 26.

In the preferred embodiment depicted in FIGS. 1 and 2, bar 16 is pivotally connected to frame 12 within receptacle 54 means of connector 22, which preferably is permanently affixed to such receptacle 54. Similarly, bar 18 is pivotally connected within receptacles 56 by means of connector 24, which preferably is permanently affixed to such receptacles 56.

By comparison, connectors 20 and 26 are preferably removable. Once they are so removed, each of bars 16 and 18 can be pivoted upwardly in the direction of arrows 60 and 62 and thereafter removed. After the removal of bars 16 and 18, a spent screen 14 may be removed, a new screen 14 may be inserted, the bars 16 and 18 may be reinserted within their respective receptacles and locked into place by connectors 20 and 26.

When bars 16 and 18 are locked into the position depicted in FIGS. 1 and 2, the screen 14 is firmly locked into place. It will be seen that the screen 14 has a multiplicity of concave surfaces 64 and 66 disposed near the ends 68 and 70 of the screen and adapted to receive the bars 16 and 18, respectively.

Figure 3:
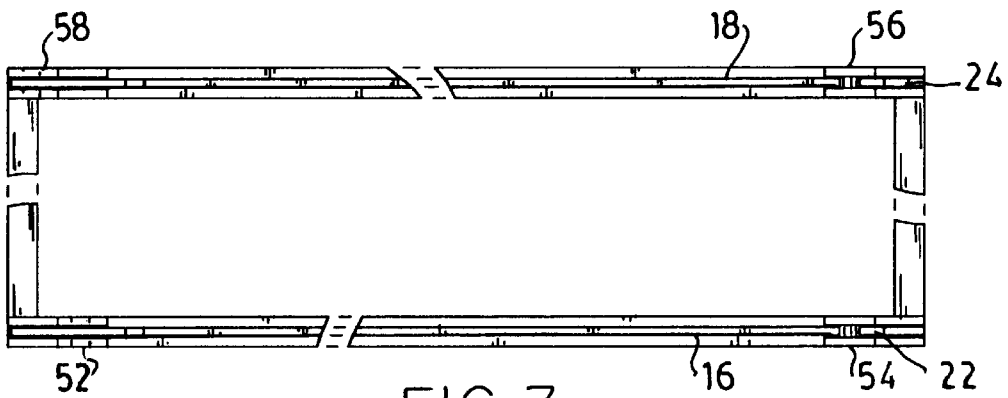
FIG. 3 is a top view of the frame of the emitter of FIG. 1.
Figure 7:
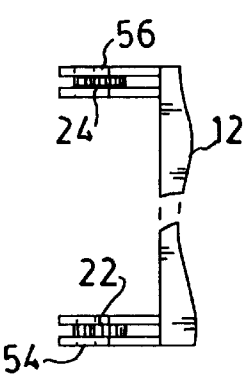
FIGS. 6 and 7 are top views of brackets which are integrally connected to the frame of the emitter of FIG. 1.
Figure 4:
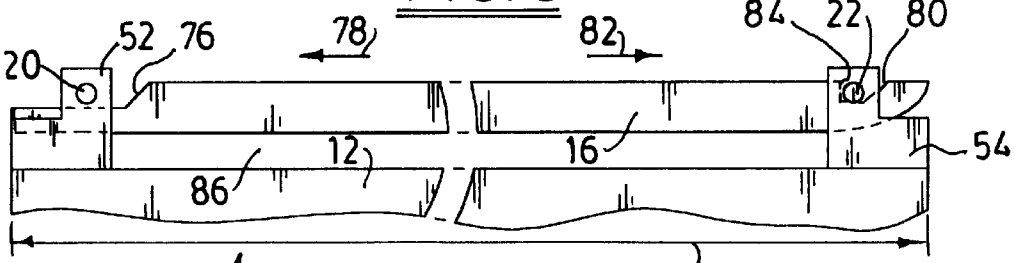
FIG. 4 is a first side view of the retaining bar within the frame of FIG. 3 of the embodiment of FIG. 1 showing the emitter radiating upwardly.
Figure 6:
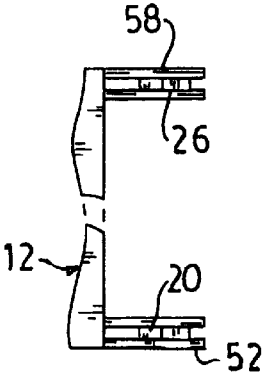

FIG. 3 is a top view of the frame of the emitter of FIG. 1. FIG. 4 is a first side view of the retaining bar 16 within the frame of FIG. 3. It will be seen that, in this embodiment, bar 16 has several preferred features which prevent its disengagement from receptacles 52 and 54.

In the first place, bar 16 has a length 74 which is at approximately equal length of the frame 12. It may be a bit shorter than frame 12, but it should not be any longer.

Bar 12 preferably has an inclined surface 76 which, when bar 12 moves in the direction of arrow 78, acts as a stop against connector 20. However, because there is some distance between surface 76 and connector 20, there is some "play " room within which bar 16 can move due to heat expansion.

Similarly, bar 12 has an inclined surface 80 which acts as a stop against connector 22 when bar 16 is moved in the direction of arrow 78. Conversely, when bar 16 is moved in the direction of arrow 82, surface 84 acts as a stop against connector 22.

When connector 20 is removed from receptacle 52, then one can readily pivot bar 16 upwardly in the direction of arrow 60 and readily disengage the bar from slotted receptacle 54.

As will be apparent to those skilled in the art, the opposing bar 18 (not shown in FIGS. 3–7) works in substantially the same manner as bar 16.

Referring again to FIGS. 4 and 5, screen 14 is disposed within space 86 and clamped between rods 16 and 18, and frame 12 (also see FIGS. 1 and 2).

FIGS. 8, 9, and 10 disclose another preferred means of removably attaching bars 16 and 18 to the frame 12. In this embodiment, instead of using the slotted receptacles 54 and 56 depicted in FIGS. 1 and 2, one may use the inclined slotted receptacle 88 best illustrated in FIG. 10. As will be apparent, this arrangement will not require a connector, such as connectors 22 and 24.

FIGS. 11, 12, and 13 illustrate several of the many connectors which may be used in the apparatus of this invention.

FIGS. 14 and 15 illustrate one means of removably connecting a bar 16 (not shown) within slotted receptacle 52. The connector 20 depicted in FIG. 14 may be twisted in the direction of arrow 90 so that the connector 20 is removably locked around wall 92 of slotted receptacle 52.

Although the novel removable locking structure of this invention has been shown with regard to one particular emitter with a frame, it will be apparent that it may be used with any emitter with a frame. Thus, the locking structure could readily be used with the emitters sold by the Impact Systems Company of California, with the emitters sold by the Optimization Technologies Company of Marietta, Ga. (which are sold under the name of "DURANIT" emitters), with the emitters sold by the Krieger Corporation of East Providence, R.I., with the emitters sold by the Marsden Corporation of Pennsauken, N.J., with the emitters sold by the Innovative Drying Systems Company of Belgium, with the emitters sold by IDS International, Inc. of West Chester, Ohio, with the emitters sold the Solaronics Company of Armentieres, France as well as their subsidiary company in the United States, and the like.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. A gas fired infrared radiation emitter comprising:

(a) a back-body provided with a distributor for distributing a fuel-oxygen containing gas mixture;

(b) a primary radiator having a combustion surface;

(c) a frame receiving at least partly said primary radiator and connecting said back-body with said primary radiator, wherein said frame is comprised of a first end and a second end, wherein said first end of said frame is comprised of a first receptacle and a second receptacle integrally connected to said first end of said frame, and wherein said second end of said frame is comprised of a third receptacle and a fourth receptacle integrally connected to said second end of said frame;

(d) a screen removably attached to said frame; and (e) a locking device comprised of:

1. a first bar removably disposed within said first receptacle and said third receptacle, and means for removably connecting said first bar to said first receptacle and said third receptacle,
2. a second bar removably disposed within said second receptacle and said fourth receptacle, and means for removably connecting said second bar to said second receptacle and said fourth receptacle, wherein:
   (a) each of said first bar and said second bar has a length which is no greater than the length of said frame, and
   (b) said screen is removably locked between said frame, and each of said first bar and said said bar;
3. means for allowing movement of said first bar towards said first end of said frame for at least about 0.15 inches, and means for limiting the amount of movement of said first bar towards said first end of said frame,
4. means for allowing movement of said first bar towards said second end of said frame for at least about 0.15 inches, and means for limiting the amount of movement of said first bar towards said second end of said frame,
5. means for allowing movement of said second bar towards said first end of said frame for at least about 0.15 inches, and means for limiting the amount of movement of said second bar towards said first end of said frame,
6. means for allowing movement of said second bar towards said second end of said frame for at least about 0.15 inches, and means for limiting the amount of movement of said second bar towards said second end of said frame,
7. means for removing said first bar from said first receptacle and said third receptacle, and
8. means for removing said second bar from said second receptacle and said fourth receptacle.

2. The gas fired infrared radiation emitter as recited in claim 1, wherein said first bar is pivotally connected to said third receptacle.

3. The gas fired infrared radiation emitter as recited in claim 2, wherein said second bar is pivotally connected to said fourth receptacle.

4. The gas fired infrared radiation emitter as recited in claim 3, wherein each of said first receptacle and said second receptacle is comprised of an open slot.

5. The gas fired infrared radiation emitter as recited in claim 4, wherein each of said third receptacle and said fourth receptacle is comprised of a closed slot.

6. The gas fired infrared radiation emitter as recited in claim 5, wherein said first bar has a first end and a second end, and wherein said second end is in the shape of rounded hinge.

7. The gas fired infrared radiation emitter as recited in claim 6, wherein said second bar has a third end and a fourth end, and wherein said fourth end is in the shape of a rounded hinge.

8. The gas fired infrared radiation emitter as recited in claim 7, wherein said frame is comprised of a multiplicity of expansion slots disposed in said frame.

9. The gas fired infrared radiation emitter as recited in claim 8, wherein said gas fired radiation emitter is comprised of a primary radiator.

10. The gas fired infrared radiation emitter as recited in claim 9, wherein said primary radiator consists essentially of sintered metal fibers.

11. The gas fired infrared radiation emitter as recited in claim 10, wherein said primary radiator has a surface areas of about 48 square inches.

12. The gas fired infrared radiation emitter as recited in claim 9, wherein said primary radiator consists essentially of perforated ceramic material.

13. The gas fired infrared radiation emitter as recited in claim 1, wherein said third receptacle and said fourth receptacle are recessed from said second end of said frame by at least about 0.2 inches.

14. The gas fired infrared radiation emitter as recited in claim 1, wherein each of said first bar and said second bar is comprised of an inclined surface.

15. The gas fired infrared radiation emitter as recited in claim 14, wherein each of said first bar and said second bar is comprised of an arcuate surface.

* * * * *